United States Patent [19]

Hisajima et al.

[11] Patent Number: 4,879,578

[45] Date of Patent: Nov. 7, 1989

[54] PAPER FEEDING DEVICE AND A PAPER GUIDING DEVICE IN A COPYING APPARATUS

[75] Inventors: Masahiko Hisajima; Hiroshi Kimura, both of Osaka; Yutaka Shigemura, Hyogo; Isao Yada, Osaka; Yoichiro Irie, Osaka; Kiyoshi Morimoto, Osaka; Takashi Nagashima, Osaka, all of Japan

[73] Assignee: Mita Industrial Co., Ltd., Osaka, Japan

[21] Appl. No.: 691,372

[22] Filed: Jan. 14, 1985

Related U.S. Application Data

[63] Continuation of Ser. No. 349,544, Feb. 17, 1982, abandoned.

[30] Foreign Application Priority Data

Mar. 2, 1981 [JP] Japan ..... 56-28445
Mar. 10, 1981 [JP] Japan ..... 56-32265[U]
Mar. 10, 1981 [JP] Japan ..... 56-32266[U]

[51] Int. Cl.[4] ..... B65H 3/44

[52] U.S. Cl. ..... 355/234; 271/9; 271/21; 271/227; 271/265; 355/309

[58] Field of Search ..... 271/9–13, 271/16, 117, 226–228, 242, 21, 272–224, 234, 235, 264, 265; 355/3 SH, 14 SH, 8

[56] References Cited

U.S. PATENT DOCUMENTS 3,804,512 4/1974 Komori et al. ..... 355/25
4,134,671 1/1979 Leonard ..... 355/8
4,243,311 1/1981 Tohyama ..... 355/8
4,429,986 2/1984 Abe et al. ..... 355/8

*Primary Examiner*—Joseph J. Rolla
*Attorney, Agent, or Firm*—Beveridge, DeGrandi & Weilacher

[57] ABSTRACT

A copying paper feeding device comprises a first and a second paper loading sections to be loaded with a stack of copying paper sheets, a first and a second paper delivery mechanism disposed respectively in the first and second paper loading sections, a first and a second paper introducing passage extending respectively from the first and second paper loading sections and terminating in a common point of junction, a paper conveying passage extending from the point of junction, a first conveyer roller pair disposed in the first paper introducing passage, and a second conveyor roller pair disposed at the point of junction or at an upstream part of the paper conveying passage. In performing a copying process, either the first or second paper delivery mechanism is selectively actuated. The first and the second conveyor roller pairs are interlocked with each other, and adapted to be started after the first or second paper delivery mechanism has been actuated. When the first paper delivery mechanism is selectively actuated, the roller pairs are started earlier by the time required to convey a copying paper from the first conveyor roller pair to the second conveyor roller pair than when the second paper delivery mechanism is actuated. The first conveyor roller pair exerts position-correcting and synchronism-adjusting actions on a copying paper delivered from the first paper loading section, and the second conveyor roller pair exerts position-correcting and synchronism-adjusting actions on a copying paper delivered from the second paper loading section.

4 Claims, 9 Drawing Sheets

PAPER FEEDING DEVICE AND A PAPER GUIDING DEVICE IN A COPYING APPARATUS

This application is a continuation of application Ser. No. 349,544, filed Feb. 17, 1982, now abandoned.

FIELD OF THE INVENTION

This invention relates to a copying paper feeding device and a copying paper guiding device in a copying machine.

DESCRIPTION OF THE PRIOR ART

In recent years, there has been widely used in copying machines a paper feeding device which includes at least two paper loading sections loaded with stacks of copying paper sheets different from each other in size, color, material, etc., and in a copying operation, selects and feeds any one type of said copying paper sheets. In such a paper feeding device, paper introducing passages are provided extending respectively from the paper loading sections. These paper introducing passages meet at a point from which a common paper conveying passage extends. A copying paper delivered from each loading section is transferred through the paper introducing passage extending therefrom, and enters the common paper conveying passage. During conveyance through the conveying passage, the copying paper undergoes necessary treatments such as the transfer of an image.

It is important that the paper feeding device of the above structure and function meet the following requirements.

(1) Generally, paper delivery from a paper loading position is carried out by the cooperation of the delivering action of a delivery roller rotating in contact with the upper surface of the topmost paper sheet in the stack and the separating action of a pair of separating members engaging both corners of the leading edge of the copying paper. The topmost paper sheet is thus separated from the other sheets in the stack and delivered. It is well known to those skilled in the art that in the aforesaid paper delivery, the two corners of the leading edge of the topmost copying paper are not always released simultaneously from the separating member. Therefore, the leading edge of the delivered paper is often not positioned at right angles to the moving direction but is inclined thereto. If the delivered paper is moved through the conveying passage while being inclined, it is often likely to undergo jamming, or a copied image inclined to the paper will be formed on the paper. Thus, firstly, it is important that before the paper delivered from the paper loading section moves through the paper conveying passage and undergoes necessary treatments, a position-correcting action should be exerted on the paper, by which the leading edge of the paper is accurately set at right angles to its moving direction.

(2) It is also known to those skilled in the art that in the paper delivery operation mentioned above which is carried out by the cooperation of the delivering action of the rotating delivery roller and the separating action of the separating members, the time interval between the point at which the rotating of the delivery roller is started and the point at which the delivered paper actually reaches a predetermined position varies depending upon conditions which affect the paper delivery operation. Moreover, it is extremely difficult, if not impossible, in designing to equalize the length of paper paths in all paper introducing passages provided in relation to the two or more paper loading sections. Accordingly, even if an attempt is made to synchronize the moving of the paper through the paper conveying passage with such a step as the exposure or transfer of the image of an original document by, for example, controlling the time of starting the rotation of the delivery roller, accurate synchronization would fail, and a deviation in position between the paper and the copied image formed thereon would occur. Thus, secondly, it is important that a synchronism-adjusting action should be exerted on the copying paper before the paper delivered from the paper loading section moves through the paper conveying passage and undergoes necessary treatments, thereby synchronizing the movement of the paper through the paper conveying passage accurately with the performance of such a step as the exposure or transfer of the image of an original document.

Known paper feeding devices which meet the first and second requirements mentioned in (1) and (2) above include those disclosed in the specifications of Japanese Laid-Open Patent Publication No. 63944/1975 and Japanese Laid-Open Utility Model Publication No. 33645/1979.

In the paper feeding device disclosed in Japanese Laid-Open Patent Publication No. 63944/1975, a conveyer roller pair is provided not only in each of the paper introducing passages extending respectively from two paper loading sections, but also at an upstream part of a common paper converying passage extending from a point of junction of the two paper introducing passages (i.e., a part which is upstream of sites at which the paper passing through the paper conveying passage undergoes necessary treatments). The conveyer roller pair provided in each of the paper introducing passages is started after the leading edge of the paper delivered from the paper loading section has abutted against it and thus the position of the paper has been corrected. In other words, the conveyer roller pair provided in each of the paper introducing passage performs a position-correcting action on a paper delivered from each loading section. On the other hand, the conveyer roller pair provided at the upstream part of the paper conveying passage is started in synchronism with such a step as the exposure or transfer of the image of an original document after the aforesaid conveyer roller pair provided in the paper introducing passage has been actuated and the leading edge of a paper transferred to the conveying passage from the introducing passage by the action of the aforesaid conveyer roller pair has abutted against the conveyer roller pair in the introducing passage. Thus, the movement of the paper through the paper conveying passage is synchronized with the performance of such a step as the exposure or transfer of the image of an original document. In other words, the conveyor roller pair provided in the upstream part of the paper conveying passage performs a synchronism-adjusting action on the copying paper introduced into the paper conveying passage.

The copying paper feeding device disclosed in the specification of Japanese Laid-Open Patent Publication No. 63944/1975 meets the first and second requirements described in (1) and (2) above, but has the following defects.

(i) The device is relatively complex and expensive because at least three conveyer roller pairs, i.e. the two conveyer roller pairs provided respectively in the two paper introducing passages and the conveyer roller pair provided at the upstream part of the paper conveying passage.

(ii) It is necessary to start the operation of each conveyer roller pair provided in the paper introducing passage and the operation of the conveyer roller pair provided in the paper conveying passage at different times. Therefore, the conveyer roller pairs provided in the paper introducing passage cannot be interlocked with the conveyer roller pair provided in the paper conveying passage and the operations of the two should be controlled separately. Hence, that construction of the feeding device which relates to the control of the operations of the conveyer rollers becomes relatively complex and expensive.

In the paper feeding device disclosed in Japanese Laid-Open Utility Model Publication No. 33645/1979, a first and a second paper introducing passage are provided in relation to a first and a second paper loading section, and a first conveyer roller pair is provided in the first paper introducing passage whereas a second conveyer roller pair is provided at a point of junction of the two paper introducing passages. When a copying paper is delivered from the first paper loading section, the first conveyer roller pair is actuated after the leading edge of the paper sent to the first paper introducing passage has abutted against the first conveyer roller pair and thus its position has been corrected. The paper which has been transferred through the first paper introducing passage is stopped upon the abutting of its leading adge against the second conveyer roller pair. Thereafter, the actuation of the second conveyer roller pair is started in synchronism with the performance of such a step as the exposure or transfer of the image of an original document, whereby the movement of the paper through the paper conveying passage is synchronized with the performance of such a step as the exposure or transfer of the image of the original document. Accordingly, on the paper delivered from the first paper loading section, the first conveyer roller pair exerts a position-correcting action, and the second conveyer roller pair, a synchronism-adjusting action. On the other hand, when a copying paper is delivered from the second paper loading section, the leading edge of the paper sent to the second paper introducing passage abuts against the second conveyer roller pair, and thus the position of the paper is corrected. Thereafter, the operation of the second conveyer roller pair is started in synchronism with the performance of such a step as the exposure or transfer of the image of the original document, whereby the movement of the paper through the paper conveying passage is synchronized with the performance of the exposing or transferring step or another required step. Accordingly, the second conveyer roller pair exerts both a position-correcting action and a synchronism-adjusting action on the paper delivered from the second paper loading section.

As stated above, according to the paper feeding device disclosed in Japanese Laid-Open Utility Model Publication, the first and second requirements described in (1) and (2) are fully met by the first and second conveyer roller pairs provided respectively in the first paper introducing passage and the point of junction between the first and second paper introducing passages, and the device is free from the defect (i) seen in the device disclosed in Japanese Laid-Open Patent Publication No. 63944/1975. In the paper feeding device shown in the above-cited Japanese Utility Model Publication, too, it is necessary to start the operations of the first and second conveyer roller pairs at different times, and the same defect as in (ii) seen in the device of Japanese Laid-Open Patent Publication No. 63944/1975 exists.

Conventional paper feeding devices further have the following defects with regard to a mechanism of delivering the topmost copying sheet from the paper stack in the loading section in every copying cycle.

The paper delivery mechanism in the paper feeding device is generally comprised of a rotatably mounted support shaft, at least one delivery roller mounted on the support shaft and a clutch for selectively connecting the support shaft to a driving source such as an electric motor. The peripheral surface of the delivery roller is kept in contact with the upper surface of the topmost paper in the stack. As a result, when the support shaft is connected to the driving source and the support shaft and the delivery roller mounted thereon are rotated in a predetermined direction, the topmost sheet of the stack is sent by the action of the delivery roller. In such a copying paper delivery mechanism, a spring clutch is conveniently used which can selectively transmit rotation in a predetermined direction and is relatively simple and inexpensive, as is well known to those skilled in the art. Furthermore, a "chain drive-type" power transmission mechanism composed of a combination of a chain and a sprocket, a combination of a belt and a belt wheel, etc. is conveniently used as means for power transmission between the input end of the spring clutch and the driving source because of its relative simplicity and low cost. However, as will be described in detail hereinbelow with reference to the accompanying drawings, the paper delivery mechanism including the spring clutch and the chain drive-type power transmission mechanism between the input end of the clutch and the driving source has been found to present a problem attributable to the peculiar behaviors of the chain drive-type power transmission mechanism and the spring slutch at the time of stopping and starting the driving source. Specifically, the problem is that when the driving source is stopped and again started while the spring clutch is out of operation (i.e. when the support shaft is disconnected from the driving source), the support shaft and the delivery roller mounted thereon are rotated in the direction of delivery of the paper sheet although to a slight extent, and therefore the topmost sheet of the paper stack is moved forward from its normal position although to a slight extent. This problem leads to a serious trouble in paper feeding devices of the type including at least two paper loading sections and paper delivery mechanisms disposed respectively for these paper loading sections. In this type of deeding devices, a particular paper delivery mechanism selected by the operator is actuated in the performance of a copying operation. A paper sheet is sent from a particular paper loading section related to the selected paper delivery mechanism. When this particular paper delivery mechanism is continuously selected through a plurality of copying cycles performed successively, the spring clutch in another paper delivery mechanism is kept out of operation and during this time, the driving source is repeatedly stopped and re-started a plurality of times. Consequently, some amount of movement occurs repeatedly in the topmost paper sheet in the stack set in a paper loading section related to the above nonselected other paper delivery mechanism, and the topmost sheet is moved forward a considerable amount from its normal position after the repetition of the copying cycle. This displacement of the topmost paper frequently results in poor paper feeding, paper jamming, etc. when the above other paper delivery mechanism is selected. Since this problem is inherent to the use of the spring clutch and the chain drive-type power transmission mechanism, it can be avoided by using another type of clutch instead of the spring clutch and another type of power transmission mechanism such as a gear drive instead of the chain drive-type power transmission mechanism. However, such other clutch and power transmission mechanism which meet the requirements are generally more complex in structure and higher in cost than the spring clutch and the chain drive-type power transmission mechanism, and make the paper delivery mechanism more complex and costly.

It is known to those skilled in the art, on the other hand, that for example in an electrostatic copying apparatus of the toner image transfer type, a sheet-like copying paper conveyed through a paper conveying passage has a toner image transferred thereon in a transfer zone, which image is then heat-fixed by a heat fixing device comprised of, for example, a pair of fixing rollers at least one of which is heated, and thereafter is discharged out of the housing of the copying apparatus while being guided by a paper guiding device. As such a paper guiding device, there is widely used a device of the type including a lower guide plate and an upper guide plate located opposite to each other and defining a paper moving passage therebetween.

This type of know paper guiding device, however, has an important problem to be solved. Specifically, since the copying paper is heated to a considerably high temperature in the heat fixing device, the copying paper which is to enter the paper guiding device from the heat fixing device is kept at a considerably high temperature. When the paper at such a high temperature is introduced into the paper moving passage of the guiding device between the upper and lower guide plates, the space between the lower and upper guide plates is heated by the heat dissipated from the copying paper, and consequently, dews tend to form on the upper side of the lower guide plate and the lower side of the upper guide plate. The dews fromed may adhere to the paper advancing through the guide means, and the paper itself and the toner image formed on it are likely to be deteriorated. Moreover, the smooth movement of the paper may be hampered, and paper jamming is likely to occur.

SUMMARY OF THE INVENTION

A first object of this invention is to provide an improved paper feeding device which remedies the aforesaid defects (i) and (ii) of the known paper feeding devices, and therefore fully meets the first and second requirements described in (1) and (2) despite its simpler structure and lower cost than the known paper feeding device.

A second object of this invention is to provide a paper feeding device which remedies the aforesaid defect associated with the paper delivery mechanism of the known paper feeding devices, and in which despite the fact that it comprises a paper delivery mechanism including a spring clutch and a chain drive-type power transmission mechanism, a support shaft and a delivery roller mounted on it do not rotate even when a driving source is stopped and re-started while the spring clutch is out of operation, and therefore the aforesaid undesirable forward displacement of the topmost paper sheet in a stack of copying paper sheets in a loading section is hampered.

A third object of this invention is to provide a paper guiding device which gives an ingenious solution to the aforesaid problems residing in the known paper guiding devices.

With regard to the first object, the present invention provides a copying paper feeding device comprising a first and a second paper loading section to be loaded with a stack of copying paper sheets, a first and a second paper delivery mechanism disposed respectively in the first and second paper loading sections, a first and a second paper introducing passage extending respectively from the first and second paper loading sections and terminating in a common point of junction, a paper conveying passage extending from said point of junction, a first conveyer roller pair disposed in the first paper introducing passage, and a second conveyer roller pair disposed at said point of junction or at an upstream part of said paper conveying passage, the length of the path of a copying paper between the first paper loading section and the first conveyer roller pair and the length of the path of a copying paper between the first conveyer roller pair and the second conveyer roller pair being respectively set shorter than the minimum length in the moving direction of a paper sheet loaded in the first paper loading section, and the length of the path of a paper between the second paper loading section and the second conveyer roller pair being set shorter than the minimum length in the moving direction of a paper sheet loaded in the second paper loading section, and either the first or second paper delivery mechanism being selectively actuated in performing a copying operation; characterized in that the first and second conveyer roller pairs are interlocked with each other and adapted to be started after the first or second paper delivery mechanism has been actuated, that when the first paper delivery mechanism is selectively actuated, said roller pairs are started earlier by the time required to convey a copying paper from the first conveyer roller pair to the second conveyer roller pair than when the second paper delivery mechanism is actuated, and that the first conveyer roller pair exerts position-correcting and synchronism-adjusting actions on a copying paper delivered from the first paper loading section, and the second conveyer roller pair exerts position-correcting and synchronism-adjusting actions on a copying paper delivered from the second paper loading section.

With regard to the second object, the present invention provides a copying paper feeding device comprising at least one paper loading section to be loaded with a stack of copying paper sheets and a paper delivery mechanism for delivering the topmost paper sheet from the paper stack in every copying cycle, characterized in that said paper delivery mechanism inclused a rotatably mounted support shaft, at least one delivery roller mounted on said support shaft, a chain drive-type power transmission mechanism whose input end is drivingly connected to a driving source a spring clutch interposed between the output end of said power transmission mechanism and the support shaft, and a restraining means for restraining the rotation of the support shaft forcibly when the spring clutch is out of operation.

With regard to the third object, the present invention provides a copying paper guiding device including a lower guide plate and an upper guide plate located opposite to each other, characterized in that the lower guide plate has provided therein laterally in spaced-apart relationship a plurality of rising pieces rising from the upper side of its main flat portion and extending in the direction of movement of a copying paper, the upper guide plate has provided therein laterally in spaced-apart relationship a plurality of hanging pieces hanging from the lower side of its main flat portion and extending in said direction of paper movement, the upper edges of the rising pieces cooperate with the lower edges of the hanging pieces to define a path of movement of the copying paper, and that openings are formed on the main flat portion of said upper guide plate.

DETAILED DESCRIPTION OF THE INVENTION

Figure 1:
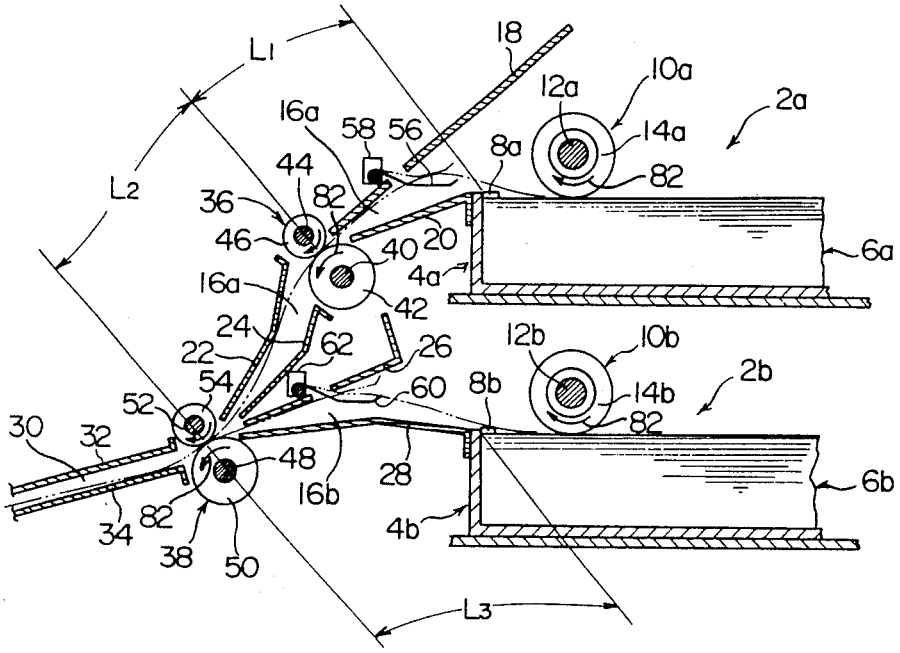
FIG. 1 is a simplified sectional view of one embodiment of the paper feeding device of the invention.

Referring to FIG. 1, the illustrated paper feeding device constructed in accordance with this invention includes two paper loading sections, i.e. a first paper loading section 2*a* and a second paper loading section 2*b*. Cassettes 4*a* and 4*b* containing copying paper sheets 6*a* and 6*b* in the stacked state are detachably mounted respectively on the first loading section 2*a* and the second loading section 2*b*. The paper sheets 6*a* may differ from the paper sheets 6*b* in size (or color, material, etc.). A pair of separating members 8*a* and a pair of separating members 8*b* (the drawing shows only one member in each pair) adapted to engage both corners of the leading edge of the topmost paper sheet in the paper stacks 6*a* and 6*b* are provided respectively at both corner portions of the upper end portions of the front edges of the cassettes 4*a* and 4*b*. A first paper delivery mechanism 10*a* and a second paper delivery mechanism 10*b* are disposed respectively in the first paper loading section 2*a* and the second paper loading section 2*b*. The first paper delivery mechanism 10*a* is comprised of a rotatably mounted support shaft 12*a* and at least one delivery roller 14*a* mounted on the support shaft 12*a*, and likewise, the second paper delivery mechanism 10*b* includes a rotatably mounted support shaft 12*b* and at least one delivery roller 14*b* mounted on the support shaft 12*b*. The structure of the first and second paper delivery mechanisms 10*a* and 10*b* will be described in greater detail hereinbelow.

The paper feeding device further includes a first paper introducing passage 16*a* extending from the first loading section 2*a* and a second paper introducing passage 16*b* extending from the second loading section 2*b*. The first paper introducing passage 16*a* is defined by a pair of a guide plate 18 and a guide plate 20 and a pair of a guide plate 22 and a guide plate 24. The second paper introducing passage 16*b* is defined by a pair of a guide plate 26 and a guide plate 28. It will be readily appreciated from FIG. 1 that the first and second paper introducing passages 16*a* and 16*b* meet at a point, and from this point of junction, a common paper conveying passage 30 (only its upstream part defined by a pair of a guide plate 32 and a guide plate 34 is shown in FIG. 1) extends.

A first conveyer roller pair 36 is disposed in the first paper introducing passage 16*a*, and a second conveyer roller pair 38 is disposed at the point of junction between the first and second paper introducing passages 16*a* and 16*b*. The first conveyer roller pair 36 consists of a driven roller 42 mounted on a rotatably mounted shaft 40 and a follower roller 46 mounted on a rotatably mounted shaft 44. Likewise, the second conveyer roller pair 38 consists of a driven roller 50 secured to a rotatably mounted shaft 48 and a follower roller 54 secured to a rotatably mounted shaft 52.

It is important in the above construction that the length $L_1$ of the path of a copying paper between the first paper loading section 2*a* and the first conveyer roller pair 36 and the length $L_2$ of the path of a copying paper between the first conveyer roller pair 36 and the second conveyer roller pair 38 should respectively be set smaller than the minimum length in the moving direction of a copying paper 6*a* delivered from the first paper loading section 2*a*, It is also important that the length $L_3$ of the path of a copying paper between the second paper loading section 2*b* and the second conveyer roller pair 38 should be set shorter than the minimum length in the moving direction of a paper 6*b* delivered from the second loading section 2*b*. So long as the above requirements about the lengths $L_2$ and $L_3$ of the path of a copying paper are met, the second conveyer roller pair 38 may also be located downstream of the position illustrated in the drawing (i.e., the point of junction between the first and second paper introducing passages 16*a* and 16*b*), and therefore at an upstream part of the paper conveying passage 30.

In the paper feeding device shown in the drawings, there are provided a first detector 58 composed of a detecting switch having a detecting element 56 projecting into the first paper introducing passage 16*a* through an opening formed in the guide plate 18 upstream of the first conveyer roller pair 36, and a second detector 62 composed of a detecting switch having a detecting element 60 projecting into the second paper introducing passage 16*b* through an opening formed in the guide plate 26.

Now, with reference to FIG. 2 taken together with FIG. 1, one example of a power transmitting and controlling mechanism will be described which serves to control and actuate as required the first paper delivery mechanism 10*a*, the second paper delivery mechanism 10*b*, the first conveyer roller pair 36 and the second conveyer roller pair 38 in the illustrated paper feeding device.

A spring clutch 64*a* known per se is secured to one end portion of the support shaft 12*a* of the first paper delivery mechanism 10*a*, and a sprocket wheel 66*a* is rotatably mounted thereon. When a control solenoid 68*a* is deenergized and an actuation controlling member 70*a* is at the arrested position shown by full lines in FIG. 2, the spring clutch 64*a* separates the support shaft 12*a* from the sprocket wheel 66*a* and therefore does not transmit the rotation of the sprocket wheel 66*a* to the support shaft 12*a*. But when the control solenoid 68*a* is energized to bring the actuation controlling member 70*a* to the non-arrested position shown by two-dotted chain lines in FIG. 2, the spring clutch 64*a* connects the shaft 12*a* to the sprocket sheet 66*a* and therefore transmits the rotation of the sprocket wheel 66*a* to the support shaft 12*a*. To one end portion of the support shaft 12*b* of the second paper delivery mechanism 10*b* is mounted a spring clutch 64*b*, and a sprocket wheel 66*b* is rotatably mounted thereon. The disconnection and connection between the shaft 12*b* and the sprocket wheel 66*b* are carried out in the same way as above by the spring clutch 64*b* depending upon the position of an actuation controlling member 70*b* which is moved by a control solenoid 68*b*. Furthermore, a spring clutch 72 is mounted on one end portion of the shaft 48 on which the driven roller 50 of the second conveyer roller pair 38 is mounted. A sprocket wheel 74 is rotatably mounted on the shaft 48. The disconnection and connection between the shaft 48 and the sprocket wheel 74 are carried out in the same way as stated above by the spring clutch 72 depending upon the position of an actuation controlling member 78 which is moved by a control solenoid 76.

Figure 2:
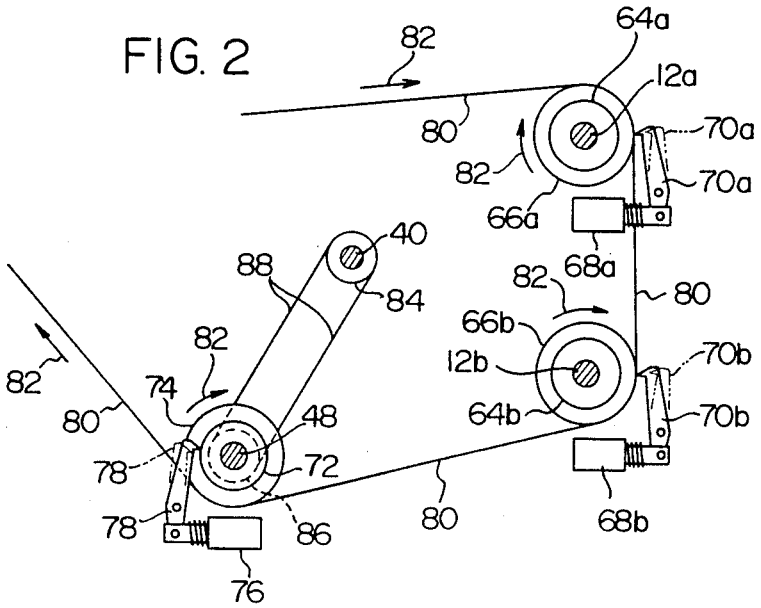
FIG. 2 is a simplified view of a power transmission and control mechanism used in the paper feeding device shown in FIG. 1.

An endless chain 80 (only a part of it is shown in FIG. 2) is wound about the sprocket wheels 66*a*, 66*b* and 74. This endless chain 80 is also wound about an input sprocket wheel (not shown) drivingly connected to a suitable driving source (not shown) such as an electric motor. Accordingly, when the driving source is energized, the endless chain 80 is driven in the direction shown by arrow 82 whereby the sprocket wheels 66*a*, 66*b* and 74 are rotated in the direction of arrow 82. Upon the energization of the control solenoid 68*a*, the spring clutch 64*a* connect the support shaft 12*a* to the sprocket wheel 66*a* and therefore the support shaft 12*a* and the delivery roller 14*a* mounted on the shaft 12*a* are rotated in the direction of arrow 82. As a result, the first paper delivery mechanism 10*a* is actuated. Likewise, when the control solenoid 68*b* is energized, the spring clutch 64*b* brings the support shaft 12*b* into engagement with the sprocket wheel 66*b*, and therefore, the support shaft 12*b* and the delivery roller 14*b* mounted on the shaft 12*b* are rotated in the direction of arrow 82. Consequently, the second paper delivery mechanism 10*b* is actuated. Furthermore, energization of the control solenoid 76 causes the spring clutch 72 to connect the shaft 48 to the sprocket wheel 74. As a result, the shaft 48 and the driven roller 50 mounted on the shaft 48 are rotated in the direction of arrow 82, and the second conveyer roller pair 38 is actuated.

On the other hand, no spring clutch is mounted on one end portion of the shaft 40 on which the driven roller 42 of the first conveyer roller pair 36 is mounted, but a sprocket wheel 84 alone is fixed to the end of the shaft 40. Corresponding to the sprocket wheel 84, a sprocket wheel 86 is fixed to the shaft 48 on which the driven roller 50 of the second conveyer roller pair 38 is mounted. An endless chain 88 is wound about the sprocket wheels 84 and 86 to interlock the shaft 40 with the shaft 48. Hence, the first conveyer roller pair 36 is interlocked with the second conveyer roller pair 38, and when the shaft 48 is rotated and the second conveyer roller pair 38 is actuated, the shaft 40 is simultaneously rotated to actuate the first conveyer roller pair 36.

Now, the operation and result of the paper feeding device described hereinabove will be described.

For example, when a main switch (not shown) of a copying apparatus equipped with the illustrated paper feeding device is closed, a driving source (not shown) is energized to drive the endless chain 80 in the direction of arrow 82, thus sprockets 66*a*, 66*b* and 74 are rotated in the direction of arrow 82. When, for example, a switch (not shown) for starting a copying cycle is then closed, one of the control solenoid 68*a* and the control solenoid 68*b* is energized. The selection of one of these control solenoids can be achieved, for example, by manually operating a switch (not shown) for paper selection.

Figure 2A:
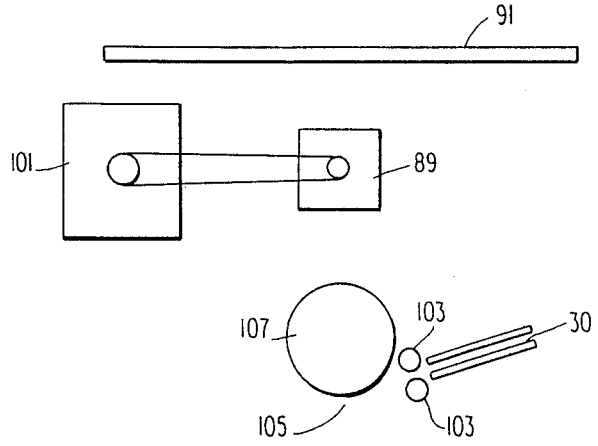
FIGS. 2A and 2B are simplified sectional views of different embodiments of certain of the components within the improved copying machine of the present invention.
Figure 2B:
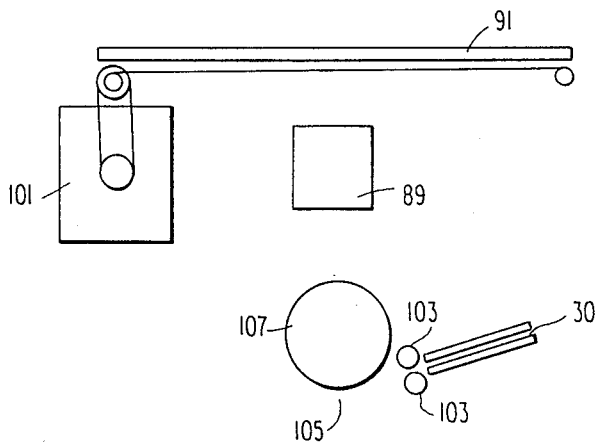

Suppose that the control solenoid 68*a* has been selected and therefore the copying paper 6*a* located in the first loading section 2*a* has been selected. Energization of the control solenoid 68*a* causes the spring clutch 64*a* to connect the support shaft 12*a* to the sprocket wheel 66*a*. Hence, the support shaft 12*a* and the delivery roller 14*a* mounted on the support shaft 12*a* are rotated in the direction of arrow 82, and the actuation of the first paper delivery mechanism 10*a* is started. Thus, by the cooperation of the delivery action of the delivery roller 14*a* rotating in the direction of arrow 82 with the separating action of the pair of separating members 8*a*, the topmost sheet of the paper stack 6*a* is separated from the rest of the stacked paper sheets and delivered to the first paper introducing passage 16*a*. The leading edge of the paper delivered to the first paper introducing passage 16*a* abuts against the nip portion of the first conveyer roller pair 36 which is out of operation, whereby in the event that the leading edge of the paper is not accurately at right angles to the moving direction of the paper, the position of the paper is corrected to set its leading edge precisely at right angles to the moving direction of the paper. Furthermore, when the leading edge of the copying paper abuts against the nip portion of the first conveyer roller pair 36, its movement is hampered whereby the paper is bent as shown by two-dotted chain line in FIG. 1. As a result, the detecting element 56 of the first detector 58 is moved from the position shown by a full line in FIG. 1, to the position shown by a two-dotted chain line in FIG. 1, whereby the first detector 58 is actuated. Upon the actuation of the first detector 58, the control solenoid 68*a* is deenergized and the actuation of the first paper delivery mechanism 10*a* is stopped. When thereafter, either optical unit 89, shown in FIG. 2A as reciprocable for exposure of the image of an original document, or original-support plate 91, shown in FIG. 2B as similarly reciprocable, is moved by reciprocating means 101 to (a first predetermined position), the control solenoid 76 is energized. This causes the spring clutch 72 to connect the shaft 48 to the sprocket wheel 74, whereby the shaft 48 and the driven roller 50 mounted on it are rotated in the direction of arrow 82 and the actuation of the second conveyer roller pair 38 is started. Simultaneously, the shaft 40 interlocked with the shaft 48 and the driven roller 42 mounted on the shaft 40 are rotated in the direction of arrow 82 and the operation of the first conveyer roller pair 36 is started. Consequently, the moving of the paper is resumed, and the paper is moved through the first introducing passage 16*a* by the first conveyer roller pair 36, and then sent to the conveying passage 30 by the second conveyer roller pair 38. Furthermore, the paper is moved through the paper conveying passage 30, in synchronism with such a step as exposure or transfer of the image of the original document, by suitable conveyor means such as a pair of conveyer rollers 103, bringing the paper to copying zone 105 adjacent drum 107.

It will thus be seen that when the paper 6*a* in the first loading section 2*a* is selected and delivered from the first loading section 2*a*, the first conveyer roller pair 36 exerts both a position-correcting action and a synchronism-adjusting action on the copying paper 6*a*.

Let us, on the other hand, assume that the control solenoid 68*b* has been selected and therefore, the copying paper 6*b* in the second loading section 2*b* has been selected. In this case, the control solenoid 68*b* is energized instead of the control solenoid 68*a*. This causes the spring clutch 64*b* to connect the support shaft 12*b* to the sprocket wheel 66*b*. Hence, the support shaft 12*b* and the delivery roller 14*b* mounted thereon are rotated in the direction of arrow 82, and the operation of the second paper delivery mechanism 10*b* is started. As a result, by the cooperation of the delivering action of the delivery roller 14*b* rotating in the direction of arrow 82 and the separating action of the pair of separating members 8*b*, the topmost paper sheet is separated from the other sheets in the paper stack 6*b* and delivered to the second paper introducing passage 16*b*. The leading edge of the paper delivered to the second paper introducing passage 16*b* abuts against the nip portion of the second conveyer roller pair 38 which is out of operation, wherby in the event that the leading edge of the paper is not accurately at right angles to the moving direction of the paper, the position of the paper is corrected to set it precisely at right angles to the moving direction of the paper. Furthermore, the movement of the leading edge of the paper is hampered upon its abutment against the nip portion of the second conveyer roller pair 38 which is not in operation. As a result, the paper is bent as shown by a two-dotted chain line in FIG. 1. This causes the detecting element 60 of the second detector 62 to move from the position shown by a full line in FIG. 1 to the position shown by a two-dotted chain line in FIG. 1, thereby actuating the second detector 62. Actuation of the second detector 62 results in the deenergization of the control solenoid 68*b*, and therefore, the operation of the second paper delivery mechanism 10*b* is stopped. When thereafter, either optical unit 89, shown in FIG. 2A as reciprocable for exposure of the image of an original or an original supporting plate 91, shown in FIG. 2B as similarly reciprocable, is moved by reciprocating means 101 to a second predetermined position, the control solenoid 76 is energized. This causes the spring clutch 72 to connect the shaft 48 to the sprocket wheel 74. Thus, the shaft 48 and the driven roller 50 mounted on it are rotated in the direction of arrow 82, and the operation of the second conveyer roller pair 38 is started (simultaneously, the operation of the first conveyer roller pair 36 is started). Consequently, the movement of the paper is resumed, and the paper is sent to the paper conveying passage 30 by the second conveyer roller pair 38. Furthermore, the paper is moved through the conveying passage 30, in synchronism with such a step as the exposure or transfer of the image of an original document, by a suitable conveyer means 101 such as a pair of conveyer rollers 103, bringing the paper to copying zone 105 adjacent drum 107.

It will thus be seen that when the paper 6*b* in the second paper loading section 2*b* is selected and delivered from the second loading section 2*b*, the second conveyer roller pair 38 exerts both a position-correcting action and a synchronism-adjusting action on the copying paper 6*b*.

The paper delivered from the first paper loading section 2*a* is stopped for a while at a position at which its leading edge abuts against the nip portion of the first conveyer roller pair 36. When the control solenoid 76 is energized to start the operations of the first conveyer roller pair 36 and the second conveyer roller pair 38, the paper is further moved from the above stop position. The copying paper delivered from the second paper loading section 2*b* is stopped briefly at a position at which its leading edge abuts against the nip portion of the second conveyer roller pair 38, and when the control solenoid 76 is energized to start the operations of the first conveyer roller pair 36 and the second conveyer roller pair 38, it is further moved from the above stop position. It is important therefore that in order to synchronize the movement of the copying paper through the conveying passage 30, as required, with such a step as the exposure or transfer of the image of an original document in the case of selecting the paper 6*a*, the operations of the first conveyer roller pair 36 and the second conveyer roller pair 38 by the energization of the control solenoid 76 should be started earlier by the time required to convey the paper from the first conveyer roller pair 36 to the second conveyer roller pair 38, than in the case of selecting the copying paper 6*b*.

Thus, according to the paper feeding device constructed in accordance with this invention, the starting of the operation of the first conveyer roller pair 36 and the starting of the operation of the second conveyer roller pair 38 are interlocked with each other instead of controlling them independently. It will be appreciated therefore that despite the fact that the construction of the actuating and controlling mechanism is simpler and cheaper than that of the conventional paper feeding device, the required position-correcting and synchronism-adjusting actions are exerted on a copying paper whether it is delivered from the first loading section 2*a* or from the second loading section 2*b*.

Although the foregoing description of the invention pertains to a paper feeding device equipped with two paper loading sections 2*a* and 2*b*, it should be understood that the invention is also applicable to paper feeding devices having 3 or more paper loading sections. In this alternative construction of the paper feeding device, paper introducing passages which meet at the aforesaid point of junction leading to the common paper conveying passage are provided in the third and subsequent paper loading sections, and a conveyer roller pair to be interlocked with the first and second conveyer roller pairs is provided in each of these additional paper introducing passages.

Now, the improvement achieved in the first and second paper delivery mechanisms 10*a* and 10*b* used in the paper feeding device described above will be described in detail.

Figure 3:
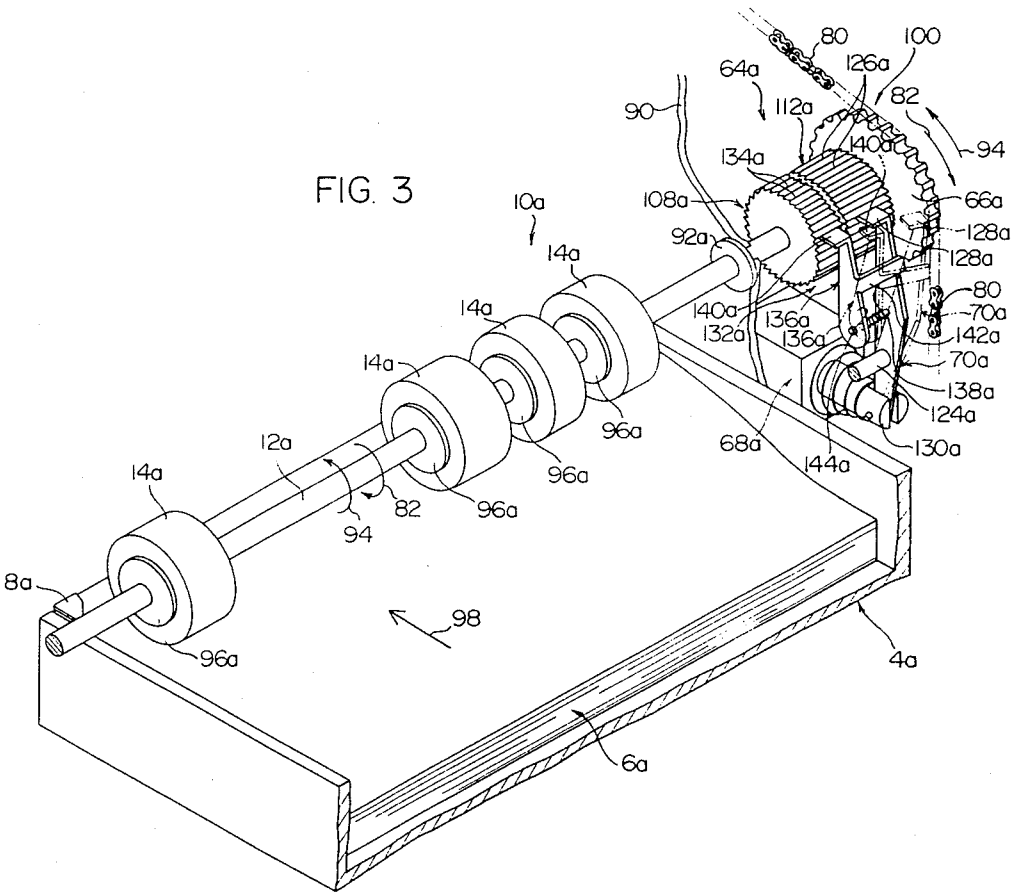
FIG. 3 is a partial perspective view showing an improved paper delivery mechanism used in the paper feeding device shown in FIG. 1.

Since the first paper delivery mechanism 10a is substantially the same as the second paper delivery mechanism 10b, only the first delivery mechanism 10a is described below in deail, and a detailed description of the second delivery mechanism 10b is omitted. Referring to FIG. 3, the support shaft 12a of the first paper delivery mechanism 10a extends laterally above the front portion of the cassette 4a loaded in the first paper loading section 2a (FIG. 1). The support shaft 12a is rotatably supported through a suitable bearing member 92a on a pair of upstanding plates 90 (only one of them is shown in FIG. 3) disposed within a housing (not shown) of a copying apparatus. The support shaft 12a has at least one (four in the illustrated embodiment) delivery roller 14a mounted thereon. Conveniently, the delivery rollers 14a are mounted on the support shaft 12a through one-way clutches 96a which transmit the rotation of the support shaft 12a to the delivery rollers 14a and rotates the delivery rollers 14a also in the direction of arrow 82 when the support shaft 12a is rotated in the direction of arrow 82, but do not transmit the rotation of the support shaft 12a to the delivery rollers 14a when the support shaft 12a is rotated in the direction of arrow 94. The peripheral surfaces of the delivery rollers 14a are kept in contact with the surface of the topmost sheet in a copying paper stack 6a. In more detail, a suitable spring member (not shown) capable of elastically biasing the front portion of the paper stack 6a is disposed at the front portion of the cassette 4a containing the paper stack 6a. By the elastic biasing action of the spring member, both corner portions of the leading edge of the topmost paper sheet is pushed against the underside of the pair of separating members 8a provided at the corners of the front edge of the cassette 4a, and the front portion of the topmost paper sheet is pushed against the peripheral surfaces of the delivery rollers 14a. Thus, when the support shaft 12a is rotated in the direction of arrow 82 and the delivery rollers 14a follow the rotation of the support shaft 12a, the topmost paper sheet is delivered forward, namely in the direction of an arrow 98.

As stated hereinabove, the support shaft 12a is connected to a chain drive-type power transmission mechanism 100 including the sprocket wheel 66a rotatably mounted on the support shaft 12a through the spring clutch 64a to be controlled by the control solenoid 68a, and the endless chain 80 wound about the sprocket wheel 66a. When the spring clutch 64a is set in operation, the sprocket wheel 66a is connected to the support shaft 12a, and the rotating motion of the sprocket wheel 66a of the chain drive-type power transmission mechanism 100 rotated in the direction of arrow 82 by a diving source is transmitted to the support shaft 12a, and consequently, the support shaft 12a and the delivery rollers 14a mounted on it are rotated in the direction of arrow 82.

Figure 4:
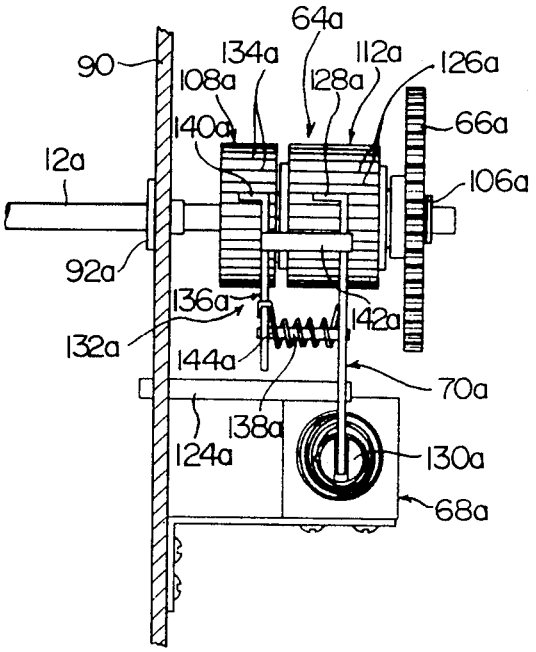
FIG. 4, 5 and 6 are respectively a side elevation, a sectional view and an exploded perspective view which show a spring clutch and its related parts in the paper delivery mechanism shown in FIG. 3.
Figure 5:
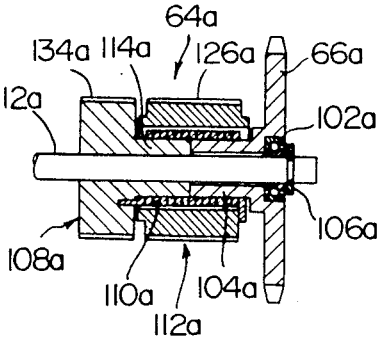
Figure 6:
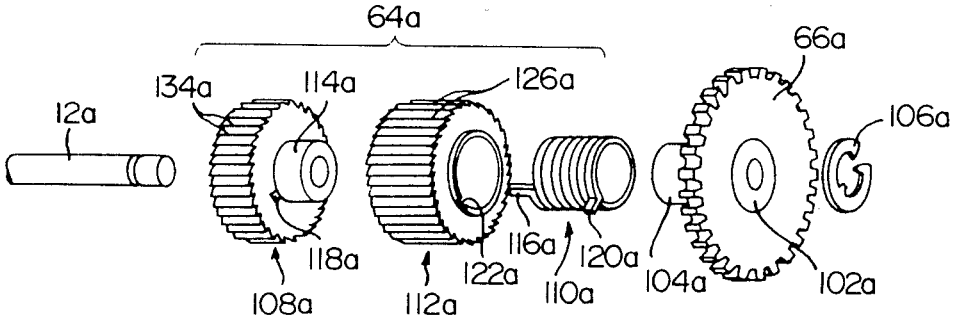

With reference to FIGS. 4 to 6 taken together with FIG. 3, the sprocket wheel 66a forming the output end of the chain drive-type power transmission mechanism 100 is rotatably mounted on the support shaft 12a through a bearing member 102a. The sprocket wheel 66a has a boss portion 104a (FIGS. 5 and 6) protruding inwardly (to the left in FIG. 5) along the support shaft 12a. Exterior of the sprocket wheel 66a is disposed a stop ring 106a mounted on the support shaft 12a for preventing the sprocket wheel 66a from moving outwardly and thus coming out of engagement with the support shaft 12a.

The spring clutch 64a which may be of any known type includes a clutch boss 108a, a coil spring 110a and a ratchet wheel 112a. The clutch boss 108a has a boss portion 114a extending outwardly along the support shaft 12a and is fixed in position to the support shaft 12a. The coil spring 110a is fitted over the boss portion 114a of the clutch boss 108a and the boss portion 104a of the sprocket wheel 66a, and the ratchet wheel 112a is fitted over the coil spring 110a. One end portion 116a of the coil spring 110a projecting inwardly in the axial direction is inserted into a slot 118a formed in the axial direction in the main portion of the clutch boss 108a, and thus connected to the clutch boss 108a. The other end portion 120a of the coil spring 110a projecting radially outwardly is inserted into a groove 122a formed in the inner circumferential surface of the ratchet wheel 112a and thus connected to the ratchet wheel 112a. The spring clutch 64a further includes the actuation controlling member 70a described hereinabove. The actuation controlling member 70a is supported pivotably about the central axis of a shaft member 124a fixed to the upstanding plate 90 by supporting it rotatably on the shaft member 124a. One end, i.e. the upper end, of the actuation controlling member 70a has formed therein an engaging piece 128a capable of engaging any one of a plurality of teeth 126a formed on the peripheral surface of the ratchet wheel 112a. On the other hand, the end portion of an iron core 130a of the control solenoid 68a is pivotably connected to the other end (i.e., the lower end) of the actuation controlling member 70a. The actuation controlling member 70a is held in the arrested position shown by full lines in FIG. 3 by the action of the spring of the control solenoid 68a when the solenoid 68a is not energized. When the actuation controlling member 70a is at the arrested position shown by full lines in FIG. 3, the engaging piece 128a of the actuating controlling member 70a engages the tooth 126a of the ratchet wheel 112a to arrest the rotation of the ratchet wheel 112a and thereby to keep the spring clutch 64a out of operation. On the other hand, when the control solenoid 68a is energized and its iron core 130a is retracted, the actuation controlling member 70a is held at the non-arrested position shown by two-dotted chain lines in FIG. 3. Upon the positioning of the actuation controlling member 70a at the non-arrested position shown by the two-dotted chain lines in FIG. 3, the engaging piece 128a of the actuation controlling member 70a comes out of engagement with the tooth 126a of the ratchet wheel 112a to release the ratchet wheel 112a from restrained rotation and thereby to set the spring clutch 64a in operation.

When the spring clutch 64a has set in action, the rotating motion of the sprocket wheel 66a in the direction of arrow 82 is transmitted to the support shaft 12a through the spring clutch 64a, and the support shaft 12a and the delivery rollers 14a mounted on it are rotated in the direction of arrow 82. In more detail, when the spring clutch 64a is in operation, a force is applied to the coil spring 110a from the boss portion 104a of the sprocket wheel 66a rotating in the direction of arrow 82 by friction between the boss portion 104a and the inner surface of the coil spring 110a, thereby decreasing the inside diameter of the coil spring 110a and fastening the coil spring 110a to the boss portion 104a of the sprocket wheel 66a and the boss portion 114a of the clutch boss 108a. As a result, the boss portion 104a is drivingly connected to the boss portion 114a by means of the coil spring 110a, and the rotating movement of the sprocket wheel 66a in the direction of arrow 82 is transmitted to the coil spring 110a, the ratchet wheel 112a and the clutch boss 108a. Thus, the coil spring 110a, the ratchet wheel 112a and the clutch boss 108a are also rotated in the direction of arrow 82, and therefore, the support shaft 12a to which the clutch boss 108a is fixed and the delivery rollers 14a mounted on the shaft 12a are rotated in the direction of arrow 82. On the other hand, when the sprocket wheel 66a is rotated in the direction of arrow 94, the rotating movement of the sprocket wheel 66a is not transmitted to the support shaft 12a even when the spring clutch 64a is in operation. When the sprocket wheel 66a is rotated in the direction of arrow 94, the inside diameter of the coil spring 110a is increased by the force transmitted to the inner surface of the spring coil 110a from the boss portion 104a of the sprocket wheel 66a. Consequently, the coil spring 110a comes out of engagement with the boss portion 104a of the sprocket wheel 66a and the rotation of the sprocket wheel 66a is not trasmitted to the coil spring 110a.

When the spring clutch 64a is not in operation, the rotating motion of the sprocket wheel 66a in the direction of arrow 82 is not transmitted to the support shaft 12a. When the spring clutch 64a is not in operation, the engaging piece 128a of the actuation controlling member 70a engages the tooth 126a of the ratchet wheel 112a to restrain the rotation of the ratchet wheel 112a. Accordingly, the coil spring 110a connected at its end portion 120a to the ratchet wheel 112a can neither be rotated, and slippage occurs between the boss portion 104a of the sprocket wheel 66a and the coil spring 110a. As a result, the rotating motion of the sprocket wheel 66a in the firection of arrow 82 is not transmitted to the support shaft 12a, and the support shaft 12a is not rotated in the direction of arrow 82.

The aforesaid construction of the illustrated first paper delivery mechanism 10 is known. A known paper delivery mechanism having only the construction described hereinabove has a problem described below. Suppose that in the above-described paper delivery mechanism 10a, the operation of a driving source (not shown) is stopped according to the completion of a copying cycle, etc. after the spring clutch 64a has been held out of operation (i.e., the state shown by full lines in FIG. 3), and thereafter the driving source is restarted according to the starting of the next cycle of copying, etc. while the spring clutch 64a is still out of operation. Then, the support shaft 12a and the delivery rollers 14a mounted on it are rotated slightly in the direction of arrow 82 owing to the peculiar behaviours of the chain drive-type power transmission mechanism 100 and the spring clutch 64a at the time of stopping and starting the driving source. This slight rotation results in the slight movement of the topmost paper sheet in the paper stack 6a in the direction of an arrow 98. This problem will be discussed in greater detail below. Generally, in the performance of a copying cycle in a copying machine, after the spring clutch 64a has been held out of operation and the rotation of the support shaft 12a and the delivery rollers 14a mounted on it in the direction of arrow 82 has been stopped, the driving power source is still kept energized to keep the chain drive-type power transmission mechanism 100 rotating in the direction of arrow 82, and after the passage of a predetermined period of time, the driving source is deenergized according to the completion of the copying cycle, etc. to stop the rotation of the chain drive-type power transmission mechanism 100 in the direction of arrow 82. While the power transmission mechanism 100 is rotated in the direction of arrow 82 and the sprocket wheel 66a is rotated in the direction of arrow 82, the coil spring 110a is expanded elastically in a direction to increase its inside diameter by the force transmitted to the coil spring 110a from the boss portion 104a of the sprocket wheel 66a by friction between the inner surface of the coil spring 110a and the boss portion 104a. Since at this time, the end portion 120a of the coil spring 110 is connected to the ratchet wheel 112a which in turn is restrained by the engagement of the engaging piece 128a of the actuation controlling member 70a with the tooth 126a, the entire coil spring 110a does not rotate, and the end portion 120a of the coil spring 110a does not move; but the main portion of the coil spring 110a is elastically expanded in a direction to increase its inside diameter by the force transmitted to the coil spring 110a from the boss portion 104a of the sprocket wheel 66a. On the other hand, when the chain drive-type power transmission mechanism 100 is rotated in the direction of arrow 82, that part of the endless chain 80 which is apart from the sprocket wheel 66a, i.e. that part which imparts a rotating force in the direction of arrow 82 to the sprocket wheel 66a (i.e., the downwardly extending portion in FIG. 3) is maintained taut by a stress acting on it, whereas that part of the endless chain 80 which is close to the sprocket wheel 66a (i.e., the part located above in FIG. 3) is relaxed. Accordingly, when the driving source is deenergized and the rotation of the power transmission mechanism 100 in the direction of arrow 82 is stopped, that part of the endless chain 80 which has been maintained taut is slightly relaxed and returns to its normal condition and that part which has been relaxed is tensioned and returns to its normal state, whereby the sprocket wheel 66a is slightly rotated in an opposite direction, i.e. in the direction of arrow 94. When the sprocket wheel 66a is slightly rotated in the direction of arrow 94 in this manner, the coil spring 110a expanded elastically in a direction to increase its inside diameter elastically returns in a direction to decrease its inside diameter and slightly shrinks, with the result that its end portion 116a moves slightly in the direction of arrow 94. Accordingly, the clutch boss 108a to which the end portion 116a of the coil spring 110a is connected and the support shaft 12a to which the clutch boss 108a is fixed are rotated slightly in the direction of arrow 94. Since, however, the delivery rollers 14a are mounted on the support shaft 12a through the one-way clutches 96a which transmit only the rotation of the support shaft 12a in the direction of arrow 82, the delivery rollers 14a are never rotated in the direction of arrow 94 even when the support shaft 12a is rotated in the direction of arrow 94. Hence, the topmost paper sheet in the stack of the paper sheets 6a is not moved at all but remains at its normal position Generally, in a copying apparatus, the driving course is re-started according to the starting of the next cycle of copying, etc. when the spring clutch 64a is still held out of operation. When the driving source is restarted in this state and the power transmission mechanism 100 is again driven in the direction of arrow 82, the coil spring 110a which was slightly shrunk elastically in a direction to decrease its inside diameter at the time of stopping the driving of the power transmission mechanism 100 is again expanded in a direction to increase its inside diameter by the force transmitted to the inside surface of the coil spring 110*a* from the boss portion 104*a* of the sprocket wheel 66*a* owing to friction between the inside surface of the coil spring 110*a* and the boss portion 104*a*. As a result, the end portion 116*a* of the coil spring 110*a* is slightly moved in the direction of arrow 82, whereby the clutch boss 108 to which the end portion 116*a* of the coil spring 110*a* is connected and the support shaft 12*a* to which the clutch boss 108*a* is fixed are slightly rotated in the direction of arrow 82. This rotation of the support shaft 12*a* in the direction of arrow 82 is transmitted to the delivery rollers 14*a* through the one-way clutches 96*a*, and therefore the delivery rollers 14*a* are also slightly rotated in the direction of arrow 82. Consequently, by the action of the delivery rollers 14*a*, the topmost sheet of the stack of paper sheets 6*a* is slightly moved forward in the direction of an arrow 98 from its normal position.

Figure 7:
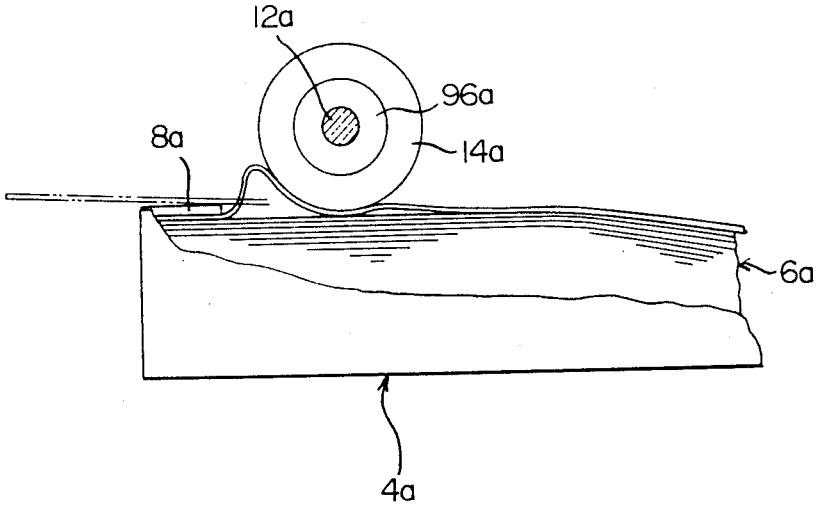
FIG. 7 is a simplified partial sectional view for illustrating the problem residing in a conventional paper delivery mechanism.

The undesirable forward movement of the paper sheet which is caused by the stopping and re-starting of the driving source when the spring clutch 64*a* is out of operation is not likely to cause serious trouble in a paper feeding device of the type which includes only one paper loading section and therefore only one paper delivery mechanism. This is because in such a type of copying apparatus, the stopping and re-starting of the driving source, in principle, are not repeated two or more times while the spring slutch 64*a* is held out of operation, and the amount of the undesirable forward movement of the paper sheet owing to one stopping and re-starting of the driving source during the nonoperating period of the spring clutch 64*a* is small, However, the aforesaid undesirable forward movement of the paper sheet is likely to cause a serious trouble in a paper feeding device of the type which includes two or more paper loading sections and paper delivery mechanisms provided for the respective loading sections. When in such a type of copying apparatus, a particular paper delivery mechanism is continuously selected in a plurality of copying cycles and therefore a particular paper delivery mechanism is repeatedly operated through these copying cycles, the spring clutch is kept out of operation in the other paper delivery mechanisms and during this time, the stopping and re-starting of the driving source are repeated a plurality of times. As a consequence, in the other paper delivery mechanism, the support shafts and the delivery rollers mounted thereon are rotated through a plurality of turns in the paper delivery direction (i.e., the direction shown by arrow 82 in FIG. 3), and the topmost sheet in a stack of paper sheets for each of the other delivery mechanisms is moved forward repeatedly. The total amount of the forward movement of each topmost sheet through these cycles becomes considerably large. Thus, the front portion of the topmost sheet becomes very wavy between the separating members 8*a* and the delivery rollers 14*a* as shown by full lines in FIG. 7, or the front portion of the topmost sheet comes out of engagement with the separating members 8*a* and projects beyond the cassette 4*a* as illustrated by two-dotted chain lines in FIG. 7. For this reason, when the topmost sheet in the other loading section is actually delivered, it may be fed in a bad condition, or may cause jamming.

According to this invention, the above problem with the known paper delivery mechanism can be solved by providing a restraining means in the paper delivery mechanism. The restraining means arrests the rotation of the support shaft and the delivery rollers mounted thereon in the direction of the arrow 82 even when the driving source is stopped and re-started while the spring clutch is kept out of operation, and thus prevents the undesirable forward movement of the paper sheet.

With reference mainly to FIGS. 3 and 4, the first paper delivery mechanism 10*a* illustrated in the drawings has a restraining means shown generally at 132*a*. The restraining means 132*a* is comprised of a plurality of teeth 134*a* provided on the peripheral surface of the main portion of the clutch boss 108*a* in the spring clutch 64*a* and a restraining member 136*a* provided in relation to the teeth 134*a*. The restraining member 136*a* is pivotably mounted on a shaft member 138*a* keyed to the actuation controlling member 70*a* in the spring clutch 64*a*. The upper end of the restraining member 136*a* has formed therein an engaging piece 140*a* capable of engaging any desired one of the teeth 134*a* provided on the outer peripheral surface of the main portion of the clutch boss 108*a*. A protruding piece 142*a* protruding toward the actuation controlling member 70*a* is also formed in the restraining member 136*a*, and a spring member 144*a* is interposed between the actuation controlling member 70*a* and the restraining member 136*a*. The spring member 144*a* elastically biases the restraining member 136*a* counterclockwise in FIG. 3 with respect to the actuation controlling member 70*a*, and elastically holds the restraining member 136*a* with respect to the actuation controlling member 70*a* at a position at which the protruding piece 142*a* abuts against the side edge of the actuation controlling member 70*a*. It will be readily appreciated therefore that the restraining member 136*a* is moved in interlocking relationship with the movement of the actuation controlling member 70*a*, and that when the actuation controlling member 70*a* is held at the arrested position shown by full lines in FIG. 3, the restraining member 136*a* is also held in the position shown by full lines in FIG. 3, and when the actuation controlling member 70*a* is held in the non-arrested position shown by two-dotted chain lines in FIG. 3, the restraining member 136*a* is also held at the position shown by two-dotted chain lines in FIG. 3. When the control solenoid 68*a* is deenergized to hold the actuation control member 70*a* at the arrested position shown by the full lines in FIG. 3 at which the spring clutch 64*a* is kept out of operation and thereby the restraining member 136*a* is held at the position shown by the full lines in FIG. 3, the engaging piece 140*a* of the restraining member 136*a* engages the tooth 134*a* formed on the peripheral surface of the main portion of the clutch boss 108*a* to restrain the rotation of the clutch boss 108*a* and the support shaft 12*a* to which the clutch boss 108*a* is fixed. On the other hand, when the control solenoid 68*a* is energized to hold the actuation controlling member 70*a* at the non-arrested position shown by the two-dot chain lines in FIG. 3 at which the spring clutch 64*a* is kept in operation and thereby the restraining member 136*a* is held at the position shown by the two-dot chain lines in FIG. 3, the engaging piece 140*a* of the restraining member 136*a* comes out of engagement with the tooth 134*a* on the peripheral surface of the clutch boss 108*a* and thus, the clutch boss 108*a* and the support shaft 12*a* to which the clutch boss 108*a* is fixed are released from restrained rotation. If desired, the restraining member 136*a* and the actuation controlling member 70*a* may be connected to each other as a unit, or formed integrally as a unit, in order to interlock them with each other.

When in the first delivery mechanism 10*a* equipped with the restraining means 132*a*, the actuation controlling member 70a is held at the arrested position shown by the full lines in FIG. 3 by the deenergization of the control solenoid 68a and thus the spring clutch 64a is kept out of operation, the restraining member 136a is held at the position shown by the full lines in FIG. 3 and its engaging piece 140a engages the tooth 134a on the peripheral surface of the main portion of the clutch boss 108a, whereby the rotation of the clutch boss 108a and the support shaft 12a to which the clutch boss 108a is fixed is restrained. This state lasts as long as the spring clutch 64a is kept out of operation. Accordingly, even when the driving source is stopped and re-started while the spring clutch 64a is out of operation, the clutch boss 108a and the support shaft 12a to which the clutch boss 108a is fixed are surely prevented from being rotated in the direction of arrow 82, and therefore, the undesirable forward movement of the topmost sheet in the paper stack 6a in the direction of arrow 98 by the rotation of the delivery rollers 14a in the direction of arrow 82 is surely hampered. The above problem with the known paper delivery mechanism can thus be solved.

Although the restraining member 136a of the restraining means 132a is interlocked with the actuation controlling member 70a of the spring clutch 64a in the illustrated embodiment, it is possible to attach a suitable control means such as a solenoid also to the restraining member 136a so that independently of the actuation controlling member 70a of the spring clutch 64a, the restraining member 136a is held optionally at the position shown by the full lines in FIG. 3 or the position shown by the two-dot chain lines in FIG. 3 by this additional control means.

In the illustrated embodiment, the restraining means 132a is constructed such that the rotation of the clutch boss 108a is restrained by engaging the engaging piece 140a of the restraining member 136a with the tooth 134a on the periphery of the main portion of the clutch boss 108a. If desired, the rotation of the clutch boss 108a may be restrained by another method, for example by applying a frictional brake band to the peripheral surface of the main portion of the clutch boss 108a. It is also possible to restrain the rotation of the support shaft 12a instead of the rotation of the clutch boss 108a.

There will now be described the paper guiding device of the invention for guiding a paper conveyed through the conveying passage, which is especially suitable for guiding a paper from a heat-fixing device in the paper conveying passage to outside the housing of a copying machine.

Figure 10:
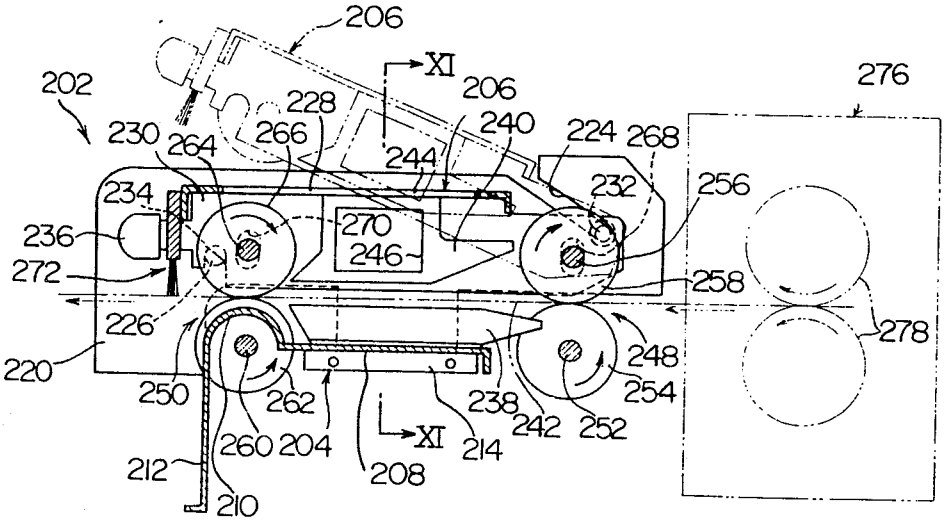
FIG. 10 is a sectional view taken along line X—X of FIG. 9.
Figure 11:
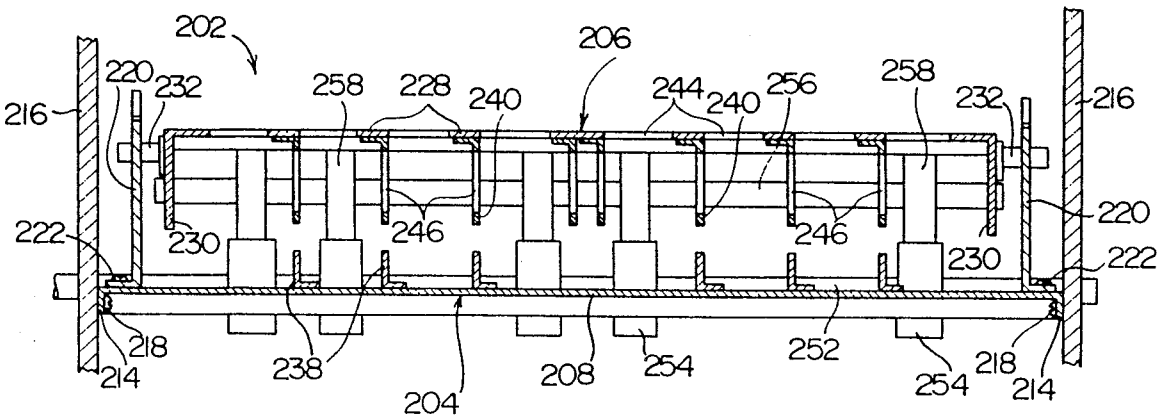
FIG. 11 is a sectional view taken along line XI—XI of FIG. 10.

Referring to FIGS. 8 to 11, the illustrated paper guiding device constructed in accordance with this invention, shown generally at 202, includes a lower guide plate 204 and an upper guide plate 206. It is easily understood from FIGS. 8 and 10 that the lower guide plate 204 in the illustrated embodiment has a main flat portion 208, a curved portion 210 following the downstream end (the left end in FIG. 10) of the main flat portion 208, and an upstanding portion 212 extending downwardly from the curved portion 210. A downwardly extending hanging portion 214 is formed integrally at each side edge of the main flat portion 208. The lower guide plate 204 is fixed in position to the housing of a copying machine by keying the hanging portion 214 by means of a setscrew 218 to the inner surface of each of a pair of upstanding partitioning plates 216 disposed laterally in spaced-apart relationship within the housing of the copying machine (the partitioning plates 216 may be the same as the upstanding plates 90 shown in FIG. 3), as shown in FIG. 11. To the upper sides of the two opposite side edges of the main flat portion 208 of the lower guide plate 204 are respectively keyed by means of setscrews 222 side plates 220 which extend upwardly from the upper sides substantially perpendicularly. In the upstream end portions (the right end portion in FIG. 10) of the side plates 220, elongated oblique groove-like notches 224 are respectively formed which extend respectively from the upper edges of the side plates 220 in the upstream direction downwardly and inclinedly. Inwardly projecting pins 226 are firmly set respectively at the downstream ends portions (i.e., the left end portions in FIG. 10) of the side plates 220.

Figure 8:
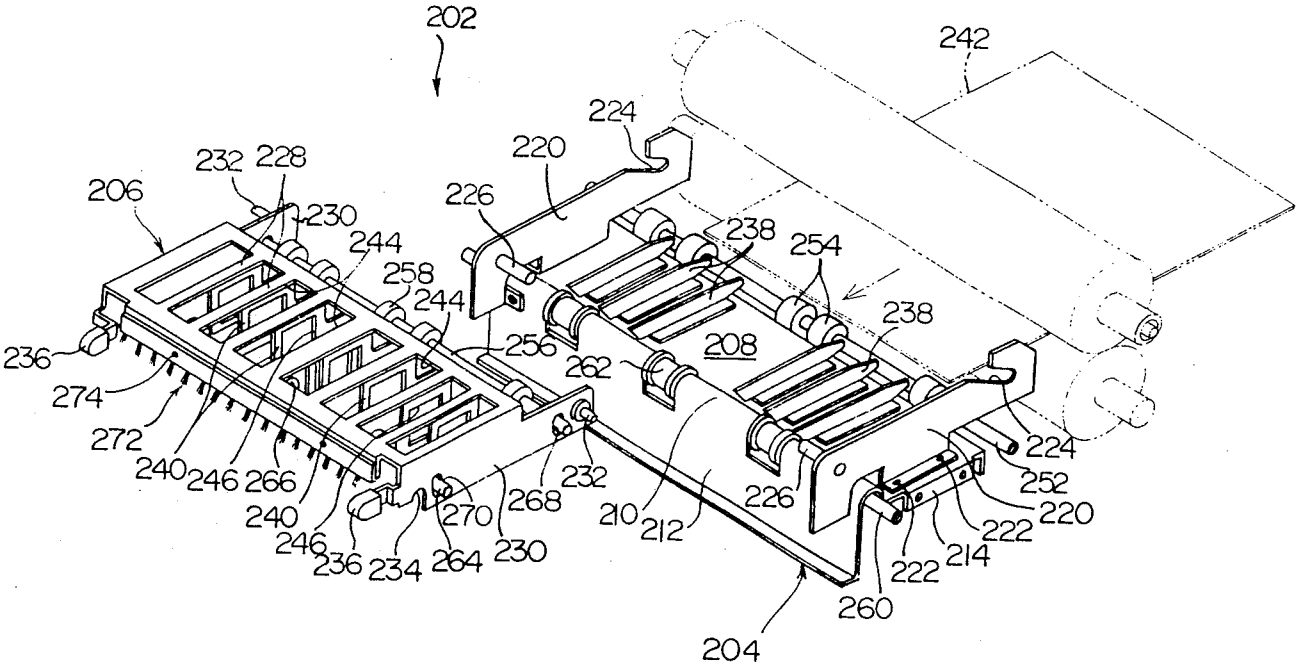
FIG. 8 is an exploded perspective view showing one embodiment of the paper guiding device of the present present invention, in which the upper guide plate is removed and separated from the lower guide plate.
Figure 9:
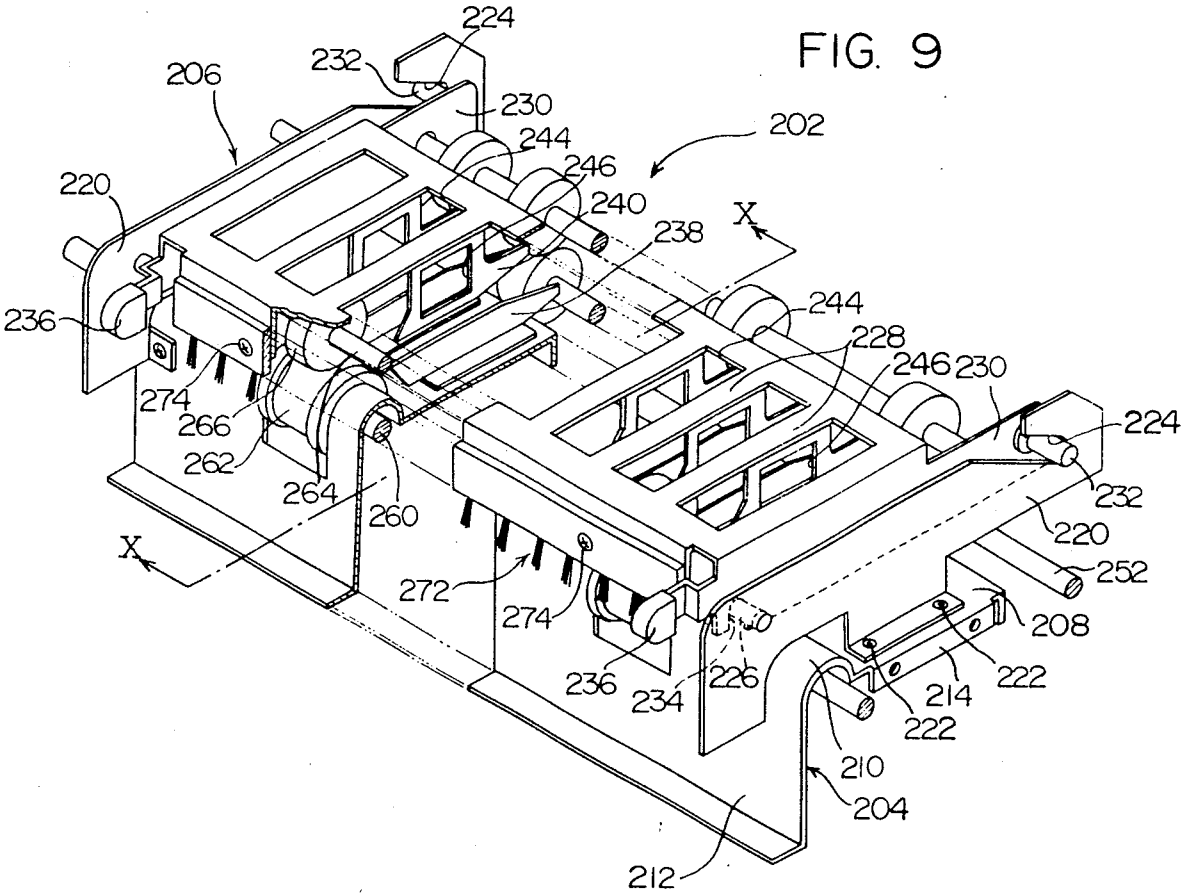
FIG. 9 is a perspective view of the guiding device shown in FIG. 8, in which the upper guide plate is mounted in place on the lower guide plate.

As is readily seen from FIGS. 8 and 10, the upper guide plate 206 has a main flat portion 228, and at the opposite side edges of the main flat portion 228, there are respectively formed as an integral unit side plates 230 which extend downwardly therefrom substantially perpendicularly. Outwardly projecting pins 232 are firmly set respectively at the upstream end portions (i.e., the right end portions in FIG. 10) of the side plates 230. Furthermore, the downstream ends (i.e., the left end portions in FIG. 10) of the side plates 230 have respectively formed therein groove-like notches 234 which extend upwardly from the lower edges of the side plates 230. Grip portions 236 projecting in the downstream directions are also respectively formed in the downstream ends of the side plates 230. It will be readily appreciated from FIGS. 9 and 10 that the upper guide plate 206 described above can be detachably mounted in position on the lower guide plate 204 by operating the aforesaid grip portions 236 so as to position the upper guide plates 206 above the lower guide plate 204 with its side plates 230 being interposed between the side plates 220 of the lower guide plate 204, then moving the upstream end portions of the side plates 230 downwardly in the upstream direction to insert the pins 232 in the notches 224 formed in the upstream end portions of the side plates 220 of the lower guide plate 204, and thereafter moving the downstream end portions of the side plates 230 downwardly to bring the notches 234 into engagement with the pins 226 firmly set at the downstream end portions of the side plates 220 of the lower guide plate 204.

It is impotant that in the paper guding device constructed in accordance with this invention, a plurality of rising pieces 238 should be provided laterally in spaced-apart relationship on the upper side of the main flat portion 208 of the lower guide plate 204, said rising pieces extending upwardly from the upper side of the main flat portion 208 in the moving direction of a copying paper (to the left and right in FIG. 10), and that corresponding to these rising pieces, the lower side of the main flat portion 228 of the upper guide plate 206 should have formed thereon a plurality of hanging pieces 240 which are disposed laterally in spaced-apart relationship and extend downwardly from the lower side of the main flat portion 228 in the moving direction of the copying paper.

As is readily seen from FIGS. 8 and 11, six rising pieces 238 are provided laterally at suitable intervals on the upper side of the main flat portion 208 of the lower guide plate 204. The rising pieces 238 are fixed in position to the upper side of the main flat portion 208 by, for example, bonding the base portions of these rising pieces to the upper side of the main flat portion 208. The rising pieces 238 extend upwardly from the upper side of the main flat portion 208 substantially perpendicularly over a predetermined range in the moving direction of the copying paper (i.e., to the right and left in FIG. 10). On the other hand, eight hanging pieces 240 are disposed laterally at suitable intervals on the lower side of the main flat portion 228 of the upper guide plate 206. The hanging pieces 240 are fixed in position to the lower side of the main flat portion 228 by, for example, bonding their base portions to the lower side of the main flat portion 228. These hanging pieces 240 extend downwardly from the underside of the main flat portion 228 substantially perpendicularly over a predetermined range in the moving direction of the copying paper (i.e., to the left and right in FIG. 10). As FIGS. 10 and 11 clearly show, the rising pieces 238 and the hanging pieces 240 cooperate with each other to define a paper moving passage therebetween. Specifically, the upper edges of the rising pieces 238 cooperate with the lower edges of the hanging pieces 240 to define a path of paper movement therebetween, and a paper 242 (see FIGS. 8 and 10) moving through the paper guiding device 202 is guided by the upper edges of the rising pieces 238 and the lower edges of the hanging pieces 240. Preferably, as is clearly shown in FIG. 10, the upstream end portions (i.e., the right end poetions in FIG. 10) of the upper edges of the rising pieces 238 are inclined downwardly in the upstream direction, and the upstream end portions of the lower edges of the hanging pieces 240 are inclined upwardly in the upstream direction, so that the copying paper 242 (see FIGS. 8 and 10) advancing between the upper edges of the rising pieces 238 and the lower edges of the hanging pieces 240 is surely and easily guided by these rising and hanging pieces. Although in the illustrated embodiment, the rising pieces 238 are formed separately from the main flat portion 208 of the lower guide plate 204 and fixed to the upper side of the main flat portion 208, and the hanging pieces 240 are likewise formed separately from the main flat portion 228 of the upper guide plate 206 and fixed to the lower side of the main flat portion 228, it is possible, if desired, to form the rising pieces 238 integrally with the main flat portion 208 as a unit and to form the hanging pieces 240 integrally with the main flat portion 228 as a unit.

It is important also that in the paper guiding device 202 constructed in accordance with this invention, openings 244 should be formed in the main flat portion 228 of the upper guide plate 206.

In the illustrated embodiment, eight rectangular openings 244 in total are formed in the main flat portion 228 of the upper guide plate 206 between the hanging pieces 240 and between the hanging pieces 240 and the side plates 230. Preferably, these openings 244 are as large as possible so long as they do not affect the rigidity and strength of the upper guide plate 206, the bonding of the hanging pieces 240 to the lower side of the main flat portion 228, etc. It is also preferred that a rectangular opening 246 be formed in each of the hanging pieces 240 themselves. Such openings 246 are also preferably as large as possible so long as they do not affect the rigidity and strength of the hanging pieces 240, etc.

The paper guiding device 202 shown in the drawings further comprises a delivery roller unit 248 disposed upstream (on the right in FIG. 10) of the paper moving passage defined by the upper edges of the rising pieces 238 and the lower edges of the hanging pieces 240, and a discharge roller unit 250 disposed downstream (on the left in FIG. 10) of the paper moving passage, as shown clearly in FIG. 10. The delivery roller unit 248 is comprised of a plurality (5 in the drawing) of driven rollers 254 mounted on a driven shaft 252 at suitable intervals in the lateral direction and a plurality (5 in the drwing) of follower rollers 258 mounted on a follower shaft 256 correspondingly to the driven rollers 254. Likewise, the discharge roller unit 250 is comprised of a plurality (3 in the drawing) of driven rollers 262 mounted on a driven shaft 260 at suitable intervals in the lateral direction and a plurality (3 in the drawing) of follower rollers 266 mounted on a follower shaft 264 correspondingly to the driven rollers 262. The driven shaft 260 of the discharge roller unit 250 is positioned below the curved portion 210 of the lower guide plate 204, but as can be easily understood from FIG. 8, the driven rollers 262 mounted on the driven shaft 260 project upwardly through cuts formed in the curved portion 210. The driven shaft 252 of the delivery roller unit 248 and the driven shaft 260 of the discharge roller unit 250 are rotatably supported on the pair of upstanding partitioning plates 216 (FIG. 11) disposed within the housing of the copying machine. On the other hand, the follower shaft 256 of the delivery roller unit 248 and the follower shaft 264 of the discharge roller unit 250 are respectively inserted rotatably for free up-and-down movement in narrow slots 268 and 270 extending in the up-and-down direction and formed on the side plates 230 disposed on the opposite side edges of the upper guide plate 206. Accordingly, the follower shaft 256 of the delivery roller unit 248 and the follower rollers 258 mounted on it and the follower shaft 264 of the discharge roller unit 250 and the follower rollers 266 mounted on it are biased downwardly by their own weights. As a result, the follower rollers 258 of the delivery roller unit 248 are brought into abutment against the driven rollers 254, and the follower rollers 266 of the discharge roller unit 250 are brought into abutment against the friven rollers 262. If required, the follower shaft 256 of the delivery roller unit 248 and the follower shaft 264 of the discharge roller unit 250 may be elastically biased down-wardly by suitable spring members (not shown). The driven shaft 252 and the driven shaft 260 are drivingly connected to a suitable driving source (not shown) such as an electric motor through a suitable power transmission means (not shown), and the delivery roller unit 248 and the discharge roller unit 250 are rotated in the direction of an arrow in FIG. 10 by the action of the driving source.

In the illustrated paper guiding device 202, a charge-eliminating brush member 272 known per se is fastened by means of a setscrew 274 to the downstream end (i.e., the left end in FIG. 10) of the upper guide plate 206. The lower end of the charge-eliminating brush member 272 contacts or approaches the surface of the paper 242 (FIGS. 8 and 10) discharged from the paper guiding device 202 by the action of the discharge roller unit 250, thereby to remove the residual charge from the paper 242.

The operation and result of the paper guding device 202 of the invention described hereinabove will now be stated.

The paper guiding device 202 constructed in accordance with this invention is suitably used for guiding the paper 242 (FIGS. 8 and 10) discharged from a heat-fixing device 276 and conducting it to outside the housing of the copying machine, although its function is not limited to this feature. For this purpose, the paper guiding device 202 is provided adjacent to, and downstream of, the heat-fixing device 276 (FIG. 10). The heat-fixing device 276 (FIG. 10), for example, includes a pair of heat-fixing rollers 278 (FIGS. 8 and 10) at least one of which is adapted to be heated by a suitable heat source (not shown) such as an electric resistance heating wire provided in its interior. By the action of such a pair of heat-fixing rollers 278, the copying paper 242 is slightly pressed to fix the toner image formed on the paper. As can be easily understood from FIG. 10, the paper 242 discharged from the heat-fixing device 276 by the feeding action of the heat-fixing rollers 278 rotated in the direction of an arrow in FIG. 10 is nipped by the delivery roller unit 248 of the paper guiding device 202 and sent to the paper guiding device 202 by the delivering action of the delivery roller unit 248. Then, the paper 242 is moved through the paper moving passage defined by the upper edges of the rising pieces 238 and the lower edges of the hanging pieces 240. Thereafter, the paper 242 is carried away from the paper guiding device 202 by the discharging action of the discharge roller unit 250, and then discharged into a receiving tray (not shown) outside the housing of the copying machine through a discharge opening (not shown) formed on the end wall of the housing.

In the heat-fixing device 276, the paper 242 is heated to a considerably high temperature by the heating action of the pair of heat-fixing rollers 278, and therefore, the paper 242 to be introduced into the paper guiding device 202 is at a considerably high temperature. When the paper 242 at such a high temperature enters the space between the lower guide plate 204 and the upper guide plate 206 of the paper guiding device 202, the space is heated by the heat dissipated from the paper 242. Since the outside of the paper guiding device 202 is generally kept at room temperature or a temperature close to it, dews tend to form on the upper side of the main flat portion 208 of the lower guide plate 204, the lower side of the main flat portion 228 of the upper guide plate 206, etc. However, because in the paper guiding device 202 of the invention, the openings 244 are formed in the main flat portion 228 and the openings 246 are also formed in the hanging pieces 240, the heat dissipated from the paper 242 passed between the lower guide plate 204 and the upper guide plate 206 is effectively dissipated out of the paper guiding device 202 through these openings 246 and 244, and consequently, the dew formation on the upper surface of the main flat portion 208, the under surface of the main flat portion 228, etc. can be effectively prevented. In addition, should such dew formation occur in the main flat portions 208 and 228, etc., the dews are not likely to adhere to the paper 242 because the paper 242 passing between the lower guide plate 204 and the upper guide plate 206 advances through the paper moving passage defined by the upper edges of the rising pieces 238 and the lower edges of the hanging pieces 240, and makes contact only with very limited areas of the upper edges of the rising pieces 238 and the lower edges of the hanging pieces 240. Consequently, no deterioration due to the adhesion of dews occurs in, the paper 242 itself or the toner image formed on it, nor is there paper jamming as a result of the smooth movement of the paper 242 being hampered by the dew formation. In more detail, when relatively large dew drops form on the upper side of the main flat portion 208 of the lower guide plate 204, or the side surfaces of the rising pieces 238, these dew drops are not likely to adhere to the paper 242. But when relatively large dew drops form on the underside of the main flat portion 228 of the upper guide plate 206 or on the side surfaces of the hanging pieces 240, these dew drops are likely to adhere to the paper 242 advancing between the lower guide plate 204 and the upper guide plate 206. According to the paper guiding device 202 constructed by this invention, the aforesaid relatively large dew drops do not form on the underside of the main flat portion 228 or on the hanging pieces 240 because openings are formed both on the main flat portion 228 and on the hanging pieces 240 to greatly reduce the heat capacity of the main flat portion 228 and the hanging pieces 240 and the actual areas of the underside of the main flat portion 228 and the side surfaces of the hanging pieces 240 on which dew could form are markedly decreased. If desired, openings may also be provided in the main flat portion 208 of the lower guide plate 204 and/or the rising pieces 238 to dissipate the heat more effectively from the space between the lower guide plate 204 and the upper guide plate 206 to outside the paper guiding device 202 and thus to further reduce the likelihood of dew formation on the upper side of the main flat portion 208 of the lower guide plate 204 and/or the side surfaces of the rising pieces 238.

What we claim is:

1. In a copying machine including an original supporting plate, an optical unit, means defining a copying zone through which copying paper passes to have formed thereon a copy of an original document supported on the original supporting plate, means reciprocally mounting one of the original supporting plate and the optical unit for scanning an image of the original document supported on the original supporting plate to enable formation of a copy of the original document on copying paper passing through the copying zone, means defining a first paper loading section and a second paper loading section, each paper loading section to be loaded with a stack of copying paper sheets, a first paper delivery mechanism and a second paper delivery mechanism, the paper delivery mechanisms disposed respectively in the first and second paper loading sections, means defining a first paper introducing passage and a second paper introducing passage, the paper introducing passages extending respectively from the first and second paper loading sections and terminating in a common point of junction, means defining a paper conveying passage extending from the common point of junction to the copying zone, and means responsive to performance of a copying operation for selectively actuating either the first paper delivery mechanism or the second paper delivery mechanism, the improvement comprising a first conveyor roller pair and a second conveyor roller pair disposed respectively in the first paper introducing passage and at the point of junction or at a downstream part of the paper conveying passage such that each of the length of the path of a copying paper between the first paper loading section and the first conveyor roller pair and the length of the path of a copying paper between the first conveyor roller pair and the second conveyor roller pair is shorter than the minimum length in the moving direction of a paper sheet loaded in the first paper loading section and the length of the path of a copying paper between the second paper loading section and the second conveyor roller pair is shorter than the minimum length in the moving direction of a paper sheet loaded in the second paper loading section, drive means for simultaneously driving the first and second conveyor roller pairs, a first detector positioned in the first paper introducing passage upstream of the first conveyor roller pair and responsive to a copying paper delivered from the first paper loading section by the action of the first paper delivery mechanism assuming a buckled condition as a result of the leading edge thereof abutting against the first conveyor roller pair for detecting such buckled copying paper and stopping the operation of the first paper delivery mechanism, a second detector positioned in the second paper introducing passage upstream of the second conveyor roller pair and responsive to a copying paper delivered from the second paper loading section by the action of the second paper delivery mechanism assuming a buckled condition as a result of the leading edge thereof abutting against the second conveyor roller pair for detecting such buckled copying paper and stopping the operation of the second paper delivery mechanism, and means responsive to scanning movement of the one of the original supporting plate and the optical unit to a first predetermined position when the first detector has detected a copying paper in the buckled condition for actuating the drive means to simultaneously drive the first and second conveyor roller pairs and transport paper along said paper conveying passage and responsive to scanning movement of the one of the original supporting plate and the optical unit to a second predetermined position when the second detector has detected a copying paper in the buckled condition for actuating the drive mechanism to simultaneously drive the first and second conveyor roller pairs and transport paper along the paper conveying passage, whereby the copying paper is conveyed through the copying zone in synchronism with the scanning of the image of the original document to properly position the copy thereof on the copying paper regardless of whether the copying paper came from the first paper loading section or the second paper loading section.

2. The improvement of claim 1 wherein each of the first and second paper delivery mechanism comprises a rotatably mounted support shaft, at least one delivery roller mounted on the support shaft, a chain drive-type power transmission mechanism having an input end and an output end with the input end adapted to be drivingly connected to a driving source, a spring clutch interposed between the output end of the chain drive-type power transmission mechanism and the support shaft and capable of alternatively assuming either of two clutch conditions, and restraining means capable of forcibly restraining the rotation of the support shaft in response to the spring clutch being in a selected one of the two clutch conditions.

3. The improvement of claim 2 wherein said restraining means comprises a clutch boss on said spring clutch, having a plurality of teeth on the peripheral surface thereof, and fixed to the support shaft, and a restraining member adapted to engage one of said teeth to restrain the rotation of the clutch boss in response to the clutch being in the first clutch condition.

4. The improvement of claim 3 wherein the restraining means further comprises an actuation controlling member interlocked with the restraining member and adapted to be selectively held at an arrested position at which the actuation controlling member operates the spring clutch to the first clutch condition or at a non-arrested position at which the actuation controlling member operates the spring clutch to the second clutch condition, the actuation controlling member bringing said restraining member into engagement with one of the teeth of the clutch boss when the actuation controlling member is held at the arrested position and out of engagement with the tooth of the clutch boss when the actuation controlling member is held in the non-arrested position.

* * * * *